United States Patent [19]

Braddick

[11] Patent Number: 4,834,185

[45] Date of Patent: May 30, 1989

[54] METHOD AND APPARATUS FOR MANIPULATING A WELL BORE LINER

[75] Inventor: Britt O. Braddick, Houston, Tex.

[73] Assignee: Texas Iron Works, Inc., Houston, Tex.

[21] Appl. No.: 144,129

[22] Filed: Jan. 15, 1988

[51] Int. Cl.[4] ..... E21B 23/00

[52] U.S. Cl. ..... 166/382; 166/208; 166/237

[58] Field of Search ..... 166/382, 381, 206, 208, 166/216, 217, 237

[56] References Cited

U.S. PATENT DOCUMENTS

| | | | |
|---|---|---|---|
| 3,920,075 | 11/1975 | Braddick et al. | 166/290 |
| 4,046,405 | 9/1977 | Bonds | 166/237 |
| 4,060,131 | 11/1977 | Kenneday et al. | 166/382 |
| 4,562,889 | 1/1986 | Braddick | 166/381 |
| 4,688,642 | 8/1987 | Baker | 166/217 |

*Primary Examiner*—Jerome W. Massie
*Assistant Examiner*—Terry Lee Melius
*Attorney, Agent, or Firm*—Jack W. Hayden

[57] ABSTRACT

Method and apparatus for supporting a liner on an operating string mandrel so that the liner can be lowered into a well bore and selectively rotated and reciprocated. The liner includes rigid splines which are initially engaged with rigid splines releasably engaged on the operating string mandrel to enable the liner to be selectively rotated and reciprocated before positioning on the well bore casing.

The liner is secured or positioned on the well bore casing and the operating string can then be manipulated to release the mandrel from the rigid splines releasably engaged thereon. The mandrel rigid splines and mandrel have cooperating surfaces which reconnect the mandrel rigid splines to the mandrel whereupon the mandrel rigid splines can then be disengaged from the liner rigid splines so that the mandrel can be released from the liner. After the operating string mandrel is released from the liner, the operating string is manipulated to reengage the rigid mandrel and liner splines for rotation of the liner after it has been secured to the casing.

13 Claims, 4 Drawing Sheets

METHOD AND APPARATUS FOR MANIPULATING A WELL BORE LINER

FIELD OF THE INVENTION

The field of the present invention relates a rigid spline arrangement for rotation of a liner in a well to condition the well for cementing operations and for rotation of the liner after it has been supported on or secured with the well bore casing.

DESCRIPTION OF THE PRIOR ART AND SUMMARY OF THE INVENTION

Various types of spline arrangements have been proposed and are in use for rotation of a liner in a well bore before and during cementation operations to cement the liner in position in the well bore.

Such devices heretofore used, such as that shown in U.S. Pat. No. 4,562,889 employ internal groove spline means formed on the liner with cooperating spline means on the operating string to enable the spline means on the liner and operating string to be selectively engaged for rotation before the liner is positioned on the casing and after it is positioned on the casing.

Such structures, for the most part, operate satisfactorily; however, in prior configurations, spring loaded members are employed which engage in recesses to form an operating connection. For example, FIG. 2 of U.S. Pat. No. 4,562,889 shows spring loaded members on an operating string which may be selectively engaged in spaced grooves in an outer member connected with a liner. In FIG. 1, rigid spline means are provided as well as a spring actuated spline arrangement.

In some instances, it may be somewhat difficult to initially positively engage the spring loaded member in the slots and under high torque conditions, it may be difficult to maintain the spring loaded member and slot engaged.

The present invention overcomes problems that might occur with a spring loaded spline connection, in that it provides a rigid spline interconnection between the operating string and an outer member for rotation both before cementing and during cementing.

Also, the present invention is directed to a spline arrangement, which by its configuration is more economical to build and more easily serviced in the field for repairs should they become necessary.

An object of the present invention is to provide a rigid spline arrangement on an operating string and a liner secured therewith, which liner is to be positioned on a casing in a well bore wherein the spline means on each the operating string and liner are initially engaged for selective rotation and/or reciprocation of the liner before securing it to the casing in the well bore. The spline arrangement of the present invention is such that the spline on the mandrel forming part of the operating string can be released from the operating string mandrel for relative longitudinal movement therebetween to enable the mandrel to be manipulated for disconnecting the mandrel spline means from the liner spline means after the liner has been hung on the casing. The operating string mandrel can then be manipulated for releasing from the liner that is secured to the well bore casing. The longitudinal movement of the operating string mandrel relative to the operating string spline means resecures the spline means to the operating string mandrel.

The operating string can then be manipulated to reengage the spline means thereon with the spline means on the liner for rotation of the liner after the operating string has been disconnected from the liner.

The construction is relatively simple, and does not require the internal machining of grooves on the liner to form a spline arrangement therein.

Other objects and advantages of the present invention will become more readily apparent from a consideration of the following description and drawings.

DESCRIPTION OF THE PREFERRED EMBODIMENTS

Figure 1:
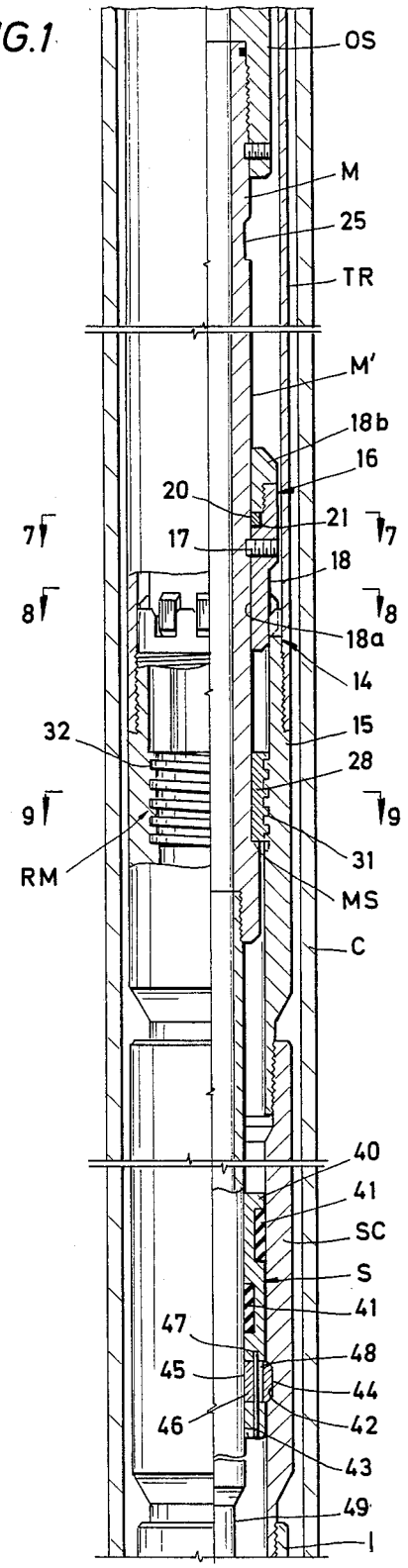
FIG. 1 is a longitudinal sectional view, partly in elevation, illustrating the operating string and liner secured together with the operating string spline releasably secured thereon and engaged with the liner spline.

Attention is first directed to FIG. 1 of the drawings wherein an operating string OS has connected therewith a mandrel M which depends from the lower end of the operating string and extends longitudinally into a tubular receptacle TR forming the upper end of a liner L, which liner includes a setting collar 15 as shown in FIG. 1.

Seal means referred to generally at S extend between the operating string and fit within the seal bore of the pack off bushing sub SC connected with the liner L for sealing between the liner and operating string as shown in FIG. 1. Means for supporting or securing the liner to the casing C are represented generally at SM in FIGS. 2 and 10. The seal means S and support means SM will be described in greater detail hereinafter.

Figure 5:
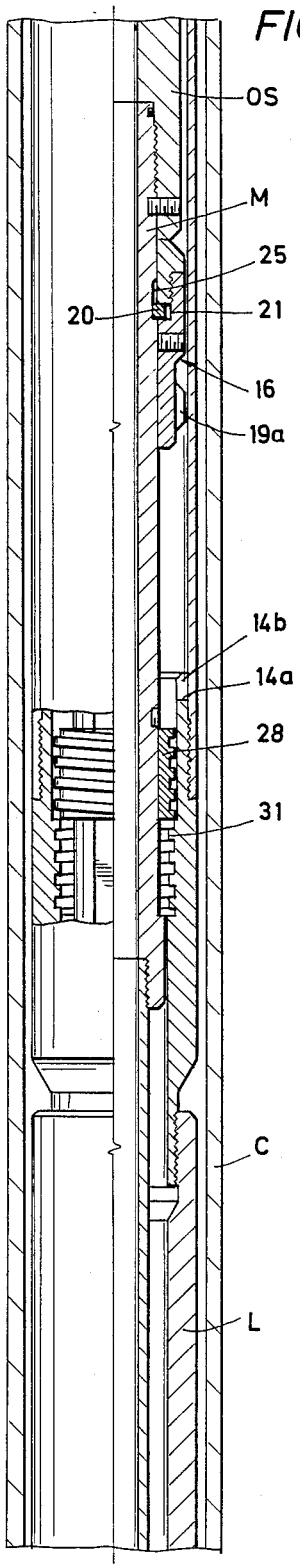
FIG. 5 is a view similar to FIG. 4 but illustrating the connect-disconnect means between the operating string and liner actuated to release the operating string from the liner that has been secured to the casing.
Figure 8:
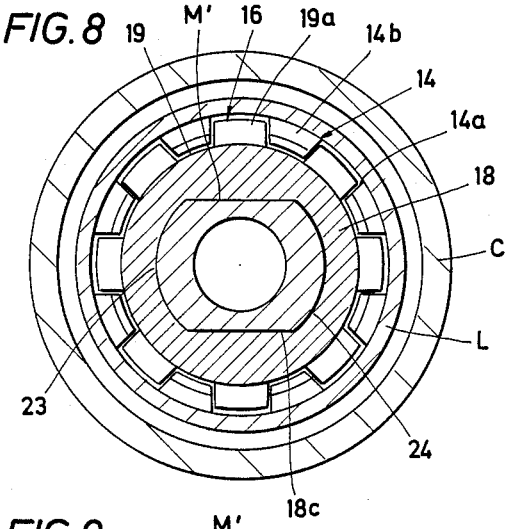
FIG. 8 is a sectional view on the line 8—8 of FIG. 1 showing further details of the operating string spline means and liner spline means.

The liner L is provided with rigid liner spline means referred to generally at 14 formed by a plurality of circumferentially spaced slots 14*a* to provide a plurality of circumferentially spaced longitudinal rigid projections 14*b* therebetween which extend inwardly from, and are adjacent the inner surface of the liner as shown in the embodiment of FIGS. 1, 5 and 8. The slots and projections are upwardly facing and are formed on the inner, upper end of the setting collar 15 forming part of the liner L as shown in FIGS. 1, 5 and 8 of the drawings. The mandrel M is provided with rigid mandrel spline means referred to generally at 16 which are releasably secured to the mandrel M by any suitable means such as the shear pin 17. The mandrel spline means includes a tubular body 18 with circumferentially spaced downwardly facing slots 19 and adjacent rigid projections 19*a* therebetween. When rigid projections 19*a* fit, or are engaged, in the slots 14*a* and projections 14*b* fit, or are engaged, in slots 19, the liner spline means 14 and operating string spline means are engaged. When in this position the liner rigid spline means 14 and operating string, or mandrel rigid spline means 16 are interlocked for rotation together. The operating string spline body means 18 is provided with a noncircular bore 18*a* which conforms with the noncircular exterior surface M' of the mandrel M so that the mandrel rigid spline means 16 is slidably but nonrotatably positioned on the mandrel M.

Figure 7:
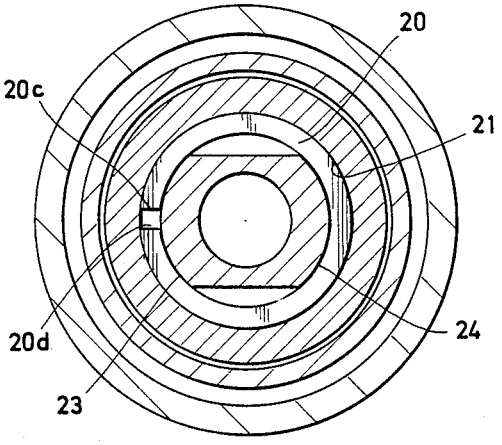
FIG. 7 is a sectional view on the line 7—7 of FIG. 1 to further illustrate details of the operating string spline means.

A cap 18*b* is threadedly engaged with the tubular body 18 of the spline means 16 as shown to assist in positioning a contractible means 20 in the groove 21 of the body 18. The body 18 and cap 18*b* form what may be considered a bushing means, and the contractible means 20 is any suitable means such as the C-ring illustrated in FIG. 7 which is expanded to fit or abut the annular portions 23 and 24 on the exterior surface of the mandrel M extending between the noncircular portions M' thereon. When thus expanded the ends 20*c* and 20*d* of the C-ring are spaced as seen in FIG. 7 so that when the mandrel M is moved longitudinally, the annular recess 25 thereon can be positioned adjacent the contractible means 20 whereupon the contractible means 20 move into the recess 25 and resecure the mandrel rigid spline means 16 to the mandrel M as will described herein.

The shear pin means 17 is a means to connect the spline means 16 to the mandrel M and is a means to disconnect the spline means 16 from the mandrel M.

Figure 9:
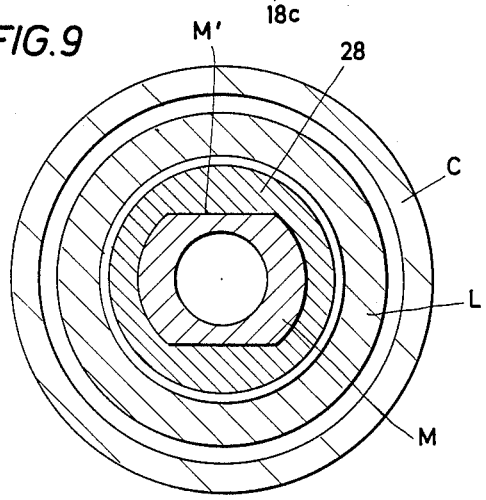
FIG. 9 is a sectional view on the line 9—9 of FIG. 1.

The mandrel M also includes annular shoulder means MS which abut the lower end of the nut 28, and such shoulder along with the shear pins means 17 and interengaged splines 14 and 16 enable the liner L to be selectively rotated and/or reciprocated in the well bore before the liner L is secured to the casing C without disconnecting the operating string from the liner. The nut 28 forms a part of the release means referred to generally by RM for releasably securing the operating string mandrel M with the liner L. Such release means includes internal threads 31 formed on the liner L as shown and external threads 32 formed on the nut for coengagement with the threads 31 for securing the operating string and liner together for lowering into the well bore and manipulation of the liner to accomplish the results of the present invention. As can be seen in FIG. 9, the noncircular portion M' of the mandrel also extends adjacent the nut means 28 so that the nut means is slidably but nonrotatably positioned on the mandrel M.

The seal means S may be of the conventional drillable or swab cup type packer form or may assume the retrievable form illustrated in FIG. 1 wherein body means 40 are provided with seal means 41 for engaging the seal bore on the interior of the liner and the exterior of the operating string mandrel for sealing therebetween.

Cooperating surface means on the liner L in the form of an annular recess or profile 42, the annular surface 43 on the operating string mandrel and the exterior annular surfaces 44, 45 on the movable members or projecting lugs 46 mounted in circumferential windows of the body 40 cooperate to engage and lock the body means 40 to the liner L to maintain a seal between the liner L and the operating string mandrel while accommodating movement of the operating string and the mandrel relative thereto. A pin 47 in enlarged passageway 48 in lugs 46 accommodates lateral movement of the lugs laterally or radially of the body 40 into and out of recess 42.

Means to unlock the cooperating surface means are provided in the form of the smaller annular diameter portion 49 on the operating string mandrel which, upon further relative longitudinal movement between the operating string and body means 40 align the smaller diameter portion 49 on the operating string mandrel with the projections or lugs 46 to accommodate their retraction from the recess 42 so that the seal means S may be retrieved from the well bore along with the operating string.

Figure 2:
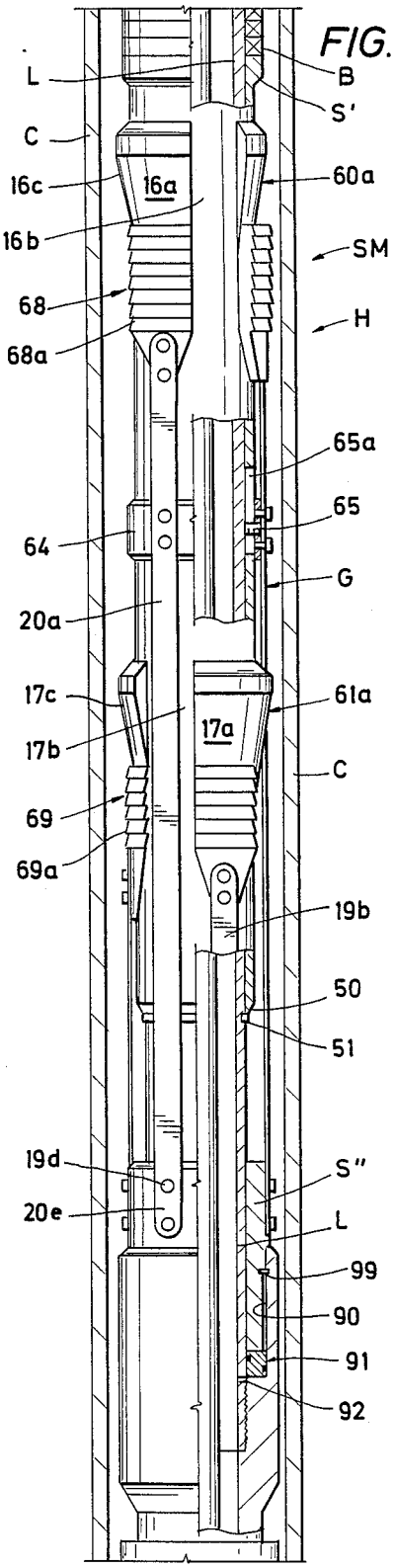
FIG. 2 is a sectional view, partly in elevation, and is a continuation of FIG. 1 showing a form of the positioning means for the liner including multiple, longitudinally spaced liner hangers which are hydraulically actuated to simultaneously set or secure with the well bore casing with bearing means for liner rotation relative to the hangers secured to the casing.
Figure 3:
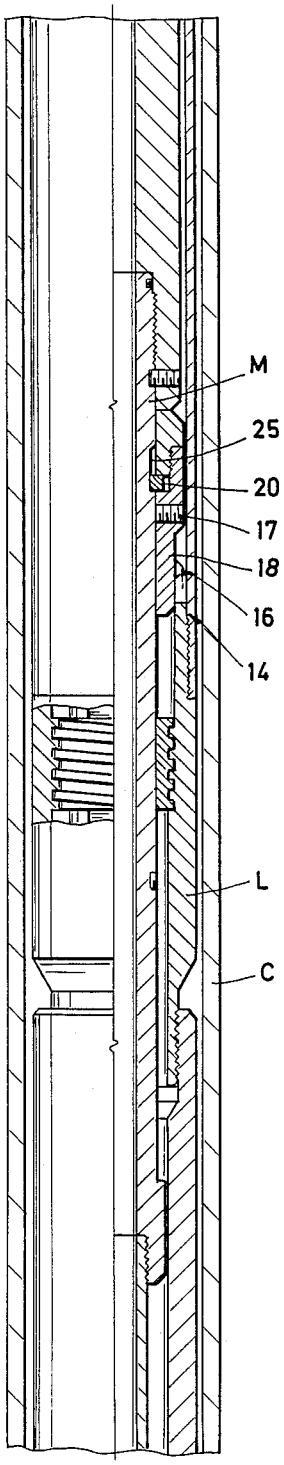
FIG. 3 is a view similar to FIG. 1 and illustrates the position of the operating string when it has been lowered after the liner has been secured to the casing to disconnect the spline means on the operating string mandrel from the operating string and the cooperating means on the operating string and operating string mandrel engaged to reconnect the operating string mandrel and the operating string spline means.
Figure 10:
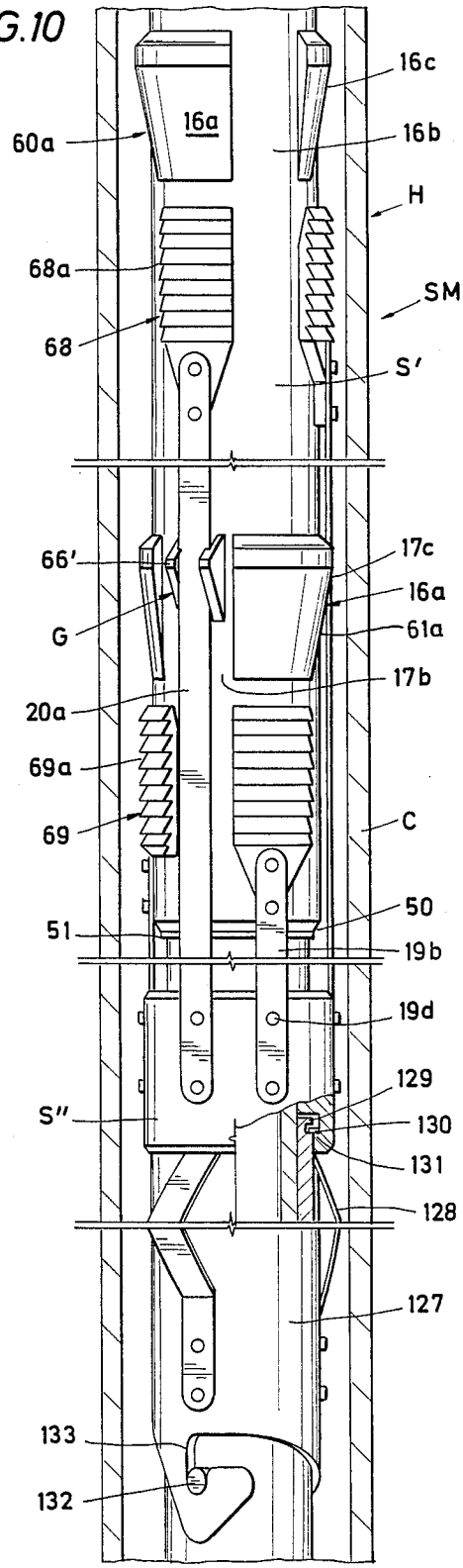
FIG. 10 is a sectional view similar to FIG. 2 but shows a mechanical arrangement for simultaneously actuating multiple longitudinally spaced hangers to set the liner on the casing in the well bore and for rotating the liner relative to the set hangers.

The liner support means for positioning or securing the liner L on the casing C includes hanger means referred to generally at H in FIGS. 2 and 10 and in the form illustrated in each of such views it will be noted that a pair of such hangers are demonstrated and are longitudinally spaced. In some circumstances only one hanger H will be employed, while in other arrangements, more than one hanger arrangement H may be employed. Where two or more hanger arrangements are provided, it may be preferrable to simultaneously set such hanger arrangements to distribute the load of the liner among the multiple liner hangers and also under some circumstances it may be desirable to rotate and/or reciprocate the liner in the well bore before hanging the liner L on the casing C to aid in conditioning the well bore as well as rotating the liner either during cementing operations in the well bore or after it has been hung.

As noted, the operating string OS includes the mandrel M depending from the lower end of the operating string. The mandrel M, as previsouly noted, has a noncircular external surface M' so it will perform its function without interferring with other operations. The liner L may have, as represented in the drawings, a member connected therewith which extends upwardly from the liner L as represented at TR.

The hanger means H is supported on the liner L for engagement with the casing C to hang or support the liner L on the well bore casing C. The liner hanger arrangements H are in effect part of the liner L since the member TR connected to the liner supports the annular bearing means B shown in FIG. 2 and a first sleeve means S'. The first sleeve means S' extends longitudinally about the liner a suitable extent and is supported thereon at its lower end 50 by annular ring 51 on liner L or other suitable means for rotation relative to the liner. The first sleeve means S' is provided with upper and lower spaced annular rows 60*a* and 61*a* of conically shaped segments 16*a* and 17*a* respectively. The conically shaped segments 16*a* in the upper row 60*a* are circumferentially spaced relative to each other by the spaces 16*b* therebetween and are offset circumferentially relative to the conically shaped segments 17*a* in the row 61*a*, which segments 17*a* are spaced circumferentially with spaces 17*b* therebetween. The conically shaped segments 16*a* and 17*a* of each row 60*a* and 61*a*, respectively, extend longitudinally of the first sleeve means S' and the segments 16*a*, 17*a* are provided with outer tapered surfaces 16*c*, 17*c* respectively.

Spaced annular rows of hanger slips 68 and 69, respecitvely, are formed by the hanger slips segments 68*a*, 69*a*, respectively, with the hanger slips 68*a* in row 68 being offset circumferentially relative to slip segments 69*a* in row 69. The slip segments 68*a* in row 68 and slip segments 69*a* in row 69 are circumferentially spaced from each other to provide circumferential spaces therebetween so that the hanger slips 68*a* are longitudinally aligned with the conically shaped segments 16*a* in row 60*a* and the hanger slips segments 69*a* are longitudinally aligned with the segments 17*a* in row 61*a*. Means in the form of elongated strips 20*a* are connected with the hanger slips 68*a* in row 60*a* and extend longitudinally of the first sleeve means S' through the spaces 17*b* between the conically shaped segments 17*a* in row 61*a* and the strips 20*a* are connected at their lower ends 20*e* by any suitable means as represented at 19*d* to the second sleeve means S".

The sleeve means S" is spaced longitudinally from the lower end 50 of the first sleeve means S' as shown in FIG. 2.

The longitudinally extending strips 20*a* may be secured to suitable guide means G which includes the collar 64 connected to the strips 20*a* between the spaced rows 60*a* and 61*a* of conical segments 16*a* and 17*a* by any suitable means such as screws or the like as shown in the drawings. The guide means G also includes projection means 65 on collar 64 fitting in the longitudinal slot 65*a* of the sleeve S' to assist in maintaining the hanger slips segments 68*a* in the row 68 aligned with the conically shaped segments 16*a* in the annular row 60*a*. In FIG. 10 the guide means G is shown as being in the form of a bracket 66' positioned on the first sleeve means S' to receive the elongated strips 20*a* and assist in maintaining the slip segments 68*a* aligned with the conical segments 16*a* in row 60*a*.

The slip segments 69*a* are connected with elongated strips 19*b* which are also connected to the second sleeve means S" by any suitable means such as screws 19*d* or the like as shown.

In the arrangement shown in FIG. 2 the second sleeve means S" is received within the annular and longitudinally extending recess or chamber 90 formed in the liner which recess is provided with a suitable seal arrangement referred to generally at 91 adjacent the lower end of the second sleeve means S" within the chamber. It can be appreciated that, if desired, the hanger arrangement may be structured and positioned so that the upper end of the slidable sleeve can be received within the chamber. The seal means 91 forms piston means and when fluid pressure is conducted from the port means 92 in the liner L to act on the piston means 91 formed by the seal arrangement within the chamber 90, second sleeve means S" is urged upwardly or outwardly of chamber 90 which in turn simultaneously moves the rows of slip segments 68 and 69 respectively toward and outwardly along the inclined surfaces 16*c*, 17*c* of the conical segments in the rows 60*a* and 61*a* respectively so that the rows of slip segments simultaneously engage and secure the liner L with the surrounding casing C.

It can be appreciated that before actuating the hanger means H hydraulically as described, suitable means to force fluid from the operating string to chamber 90 is employed. For example, a ball or plug means can be pumped or dropped down the operating string to seat on a seat in the liner and close off flow therethrough, so that flow is conducted to port 92. The fluid pressure in chamber 90 actuates the second sleeve means as above described so that it moves longitudinally relative to sleeve S' and engage slip segments 68*a*, 69*a* simultaneously on their respective segments 16*a*, 17*a* and thereby suspend the liner L on the casing C. The simultaneous setting of the slips on the casing assists in distributing the load of the liner more equally on the longitudinally spaced liner hanger arrangement H.

The guide means G engage the strips 20*a* which are in turn secured to the second sleeve S". The second sleeve S" is in turn supported in the chamber 90 formed in the liner L. To prevent premature actuation of the hanger means H, the second sleeve means S" may be secured to liner L in chamber 90 by shear pin 99 which shears upon a predetemrined pressure from the operating string through port 92 in the liner L to the chamber 90 to shear for accommodating relative longitudinal movement between the sleeve means S' and S" for simultaneously setting the hangers with the casing C as previously described. The annular chamber 90, seal arrangement 91 and shear means 99 thus form releasable means for releasably securing said second sleeve means S" to the liner.

FIG. 10 illustrates a hanger arrangement where the hanger means H may be mechanically set. As noted previously, FIG. 2 is a continuation of FIG. 1 and when the mechanical set arrangement of FIG. 10 is employed, then the hydraulic form of FIG. 2 is eliminated and the structure shown in FIG. 10 would be substituted therefor to form a continuation of FIG. 1. While the bearing means B is not shown in FIG. 10, it would assume the same relative position in FIG. 10 as is shown in FIG. 2.

As noted above, the sleeve means S' in FIG. 10 is rotatably supported on liner L for rotation relative thereto by bearing means similar to that shown in FIG. 2. The sleeve S' is supported at its lower end 50 by an annular ring 51 as described with regard to FIG. 2. The mechanical form also includes longitudinally spaced rows 60*a*, 61*a* of conical segments 16*a*, 17*a*, both of which are mounted on the first sleeve means S'. Although two rows are shown, additional rows of segments may be employed either in the hydraulic or mechanical form, if desired, as well as a similar number of multiple rows of slip segments. The longitudinally spaced rows 68 and 69 of slip segments 68*a*, 69*a* are similar to those previously described. The strips 20*a* and 19*b* in each FIGS. 2 and 10 are secured, respectively, at one end to the slip segments 68*a*, 69*a* in rows 68, 69 of slip segments, and at their other end to sleeve means S" as shown at 19*d* in the drawings. The sleeve means S" is spaced longitudinally relative to sleeve means S'. The second sleeve means S" includes an extension 127 on which are mounted the circumferentially, longitudinally extending bow spring means 128. The second sleeve means S″ is rotatably supported relative to the extension 127 by means of the overhanging shoulder 129 resting on the ring 130 supported on the ledge 131 of second sleeve S″. When rotation is imparted to the operating string OS after the arrangement of FIGS. 1 and 10 is lowered to position in the well bore, rotation of the liner hanger arrangements H is restrained by the bow springs 128 so that 127 tends to remain stationary while the liner rotates to thereby disengage pin 132 from the J-slot arrangement 133 adjacent the lower end of extension 127 forming part of second sleeve means S″. The J-slot 133 and pin 132 form a releasable connection between the second sleeve S″ and liner L in the FIG. 10 form. The J-slot 133 may be configured to release from pin 132 by right-hand or left-hand rotation of the operating string, since the nut 28, mandrel spline 16, liner spline 14, and shear pin 17 maintain the operating string and liner secured together. Also, the circumferentially spaced bow springs 128 restrain longitudinal movement between the liner hanger arrangements H and the operating string O and liner L relative to 127 so that subsequent lowering of the operating string O and liner L relative to 127 after disconnection of pin 132 from J-slot 132 effects relative longitudinal movement between the second sleeve means S″ and sleeve means S′ to urge the row 68 of slip segments 68*a* and row 69 of slip segments 69*a* on to their respective concically shaped segment rows 60*a* and 61*a* for securing the liner to the casing C.

As noted previously, it may be desirable in some instances to rotate and/or reciprocate the liner L in the well bore to condition the well bore before the cementing operation, previously described, is begun. Also it may be desirable to rotate the liner L during cementing operations. The shoulder means MS on the mandrel M engages the lower end of nut 28 to enable the liner L to be reciprocated in the well bore by raising and lowering the operating string O when it is assembled as shown in FIG. 1 and before the liner is hung on the casing C.

Where it is desired to rotate the liner L before supporting it on the casing C, the spline means 14 on liner L and spline means 16 on mandrel M, along with the shear pin 17 and nut 28 remain engaged at this time whereby the liner L may be rotated by rotating the operating string at the earth's surface.

In normal cementing operations, the operating string is usually manipulated to disengage the nut 28 before cementing operations are started so that the operating string and mandrel M may be retrieved from the liner L in the well bore in the event of some malfunction during the cementing operation. This avoids cementing the entire operating string O in the well bore. The present invention enables either a left-hand or a right-hand setting nut 28 to be employed as may be desired.

After the operating string has been lowered to the position where it is desired to hang or suspend on the casing, the operating string can be rotated and/or reciprocated to impart rotation and/or reciprocation to the liner before it is secured to the casing. Other procedures, such as circulation are also continued, if desired. The liner is then secured to the casing by the hanger means H by the procedure as described above.

The operating string OS is then manipulated, namely it is lowered so as to shear the frangible means 17 which releases the operating string OS from its rigid spline means 16. The operating string is then lowered relative to its rigid spline means 16 until the recess 25 is positioned adjacent the contractible C-ring 20 whereupon the C-ring, since it is in abutting relationship with the outer surface of the mandrel M, contracts into the recess 25 and resecures the rigid mandrel spline means 16 to the mandrel as shown in FIGS. 3, 4, 5 and 6. The C-ring and recess provide cooperating surfaces to reconnect rigid spline 16 to the mandrel M.

Figure 4:
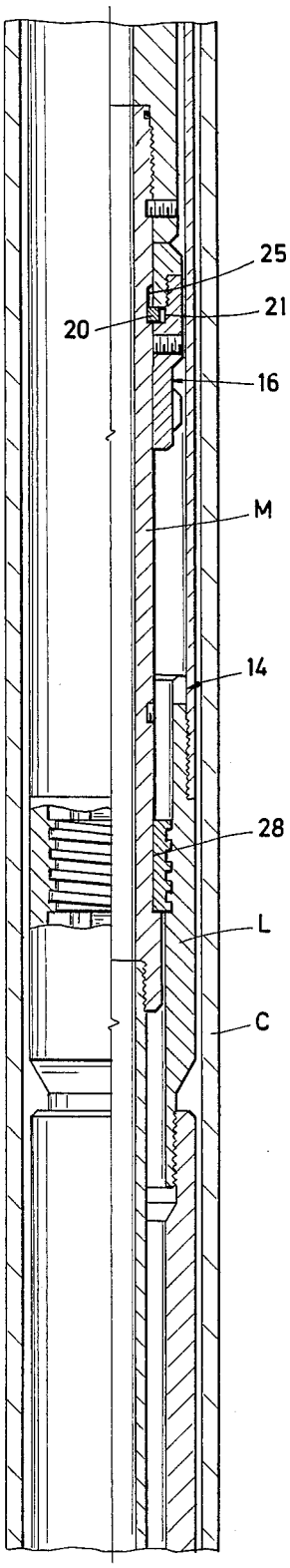
FIG. 4 is a view similar to FIG. 1 showing the operating string and the operating string mandrel means after reconnection and elevated to disengage from the liner spline means.

The mandrel 18 and the reconnected rigid spline means 16 can then be elevated as illustrated in FIG. 4 which disconnects the mandrel rigid spline means 16 from liner rigid spline means 14. The operating string can then be rotated either in a right-hand direction or left-hand direction depending upon the thread configuration on the nut 28 and liner L to disengage the nut 28 from the liner L and thereby disconnect the operating string from the liner L.

Figure 6:
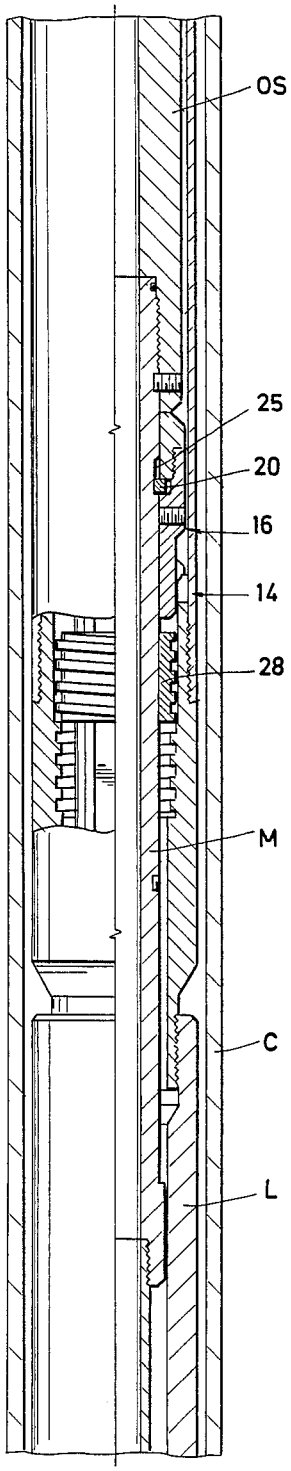
FIG. 6 is a view similar to FIG. 5 but illustrates the operating string lowered to reengage the operating string mandrel spline with the liner spline for rotation of the liner during cementing.

This disconnected position is illustrated in FIG. 5 of the drawings. In FIG. 6, the operating string is shown as having been again lowered to reengage the mandrel rigid spline 16, which is now secured to the mandrel M, with the liner rigid spline 14 to enable rotation to be imparted to the liner L through the bearing means B during cementing operations to cement the liner in position in the well bore.

Thereafter, the operating string OS and mandrel M can be retrieved to the earth's surface along with the retrievable seal means S illustrated in FIG. 1 of the drawings.

The rigid mandrel spline and rigid liner spline of the present invention may be less likely to disengage under high torque, than spring loaded, or actuated connections where the torque may effect disconnection. Thus, the present invention with the rigid interconnection may more than likely retain the splines engaged to assure continued rotation as may be desired.

The foregoing disclosure and description of the invention are illustrative and explanatory thereof, and various changes in size, shape and materials as well as in detail of the illustrated construction may be made without departing from the spirit of the invention.

What is claimed is:

1. An arrangement for supporting on an operating string to manipulate and position a rotatable liner on a casing in a well bore, said arrangement comprising:

setting collar means for suspending the rotatable liner therefrom;

internal thread means on said setting collar means;

a mandrel for connection with the operating string;

nut means slidably but non-rotatably positioned on said mandrel;

external thread means on said nut means for engaging said internal thread means on said setting collar means;

shoulder means on said mandrel for abutting said nut means when said external and internal thread means are engaged whereby said setting collar means and liner may be suspended from the operating string;

upwardly facing spline means formed internally on said setting collar and positioned above said nut means when said nut means and setting collar means are threadedly connected together;

bushing means on said mandrel for slidable but non-rotatable movement relative thereto, said bushing means including:

downwardly facing spline means for coengagement with said upwardly facing spline means on said setting collar; and contractible means abutting said mandrel;

release means for releasably securing said bushing means to said mandrel and for releasably securing said spline means on said bushing means in coengagement with said spline means on said setting collar means whereby the liner may be rotated and reciprocated in the well bore by the operating string before positioning on the casing;

recess means on said mandrel longitudinally spaced from said contractible means when said release means secures said bushing means to said mandrel; and said release means operable by longitudinal movement of said mandrel after the liner is positioned on the casing to disconnect said bushing means from said mandrel so that said recess means and contractible means may be aligned for engagement to reconnect said bushing means with said mandrel.

2. An arrangement for supporting on an operating string to manipulate and position a rotatable liner on a casing in a well bore, said arrangement comprising:

a mandrel for connection with the operating string;

release means for releasably connecting said mandrel with the liner, said release means actuatable after the liner is supported on the casing to disconnect said mandrel from the liner;

liner rigid splines on the liner;

mandrel rigid splines on said mandrel;

mandrel release means releasably securing said mandrel rigid splines on said mandrel and in engagement with said liner rigid splines for rotation and reciprocation of the rotatable liner in the well bore, said mandrel release means actuatable to release said mandrel rigid splines from said mandrel upon relative longitudinal movement therebetween after the liner has been positioned on the casing; and cooperating means on said mandrel and mandrel rigid splines coengageable upon predetermined longitudinal movement of said mandrel to resecure said mandrel splines with said mandrel whereby said mandrel and liner rigid splines may be reengaged for rotating the liner by the operating string after the liner has been positioned on the casing.

3. An arrangement to be secured on an operating string to manipulate and position a liner on a casing in a well bore, said arrangement comprising:

a mandrel for connection with the operating string;

first release means including threads on the interior of the liner and on the exterior of said mandrel for releasably connecting said mandrel with the liner, said release means actuatable by rotation of said mandrel relative to the liner after the liner is supported on the casing to disconnect said mandrel from the liner;

liner rigid splines on the liner; mandrel rigid spline means on said mandrel;

shear release means for releasably securing said mandrel rigid spline means on said mandrel to engage with said liner rigid splines for rotation and reciprocation of the rotatable liner in the well bore, said shear release means actuatable to release said mandrel rigid spline means from said mandrel upon relative longitudinal movement therebetween after the liner has been positioned on the casing and prior to actuation of said first release means; and means including annular recesses on said mandrel and mandrel rigid spline means and a contractible member carried by said mandrel rigid spline means cooengageable upon relative longitudinal movement between said mandrel rigid spline means and mandrel to reconnect said mandrel and mandrel rigid spline means whereupon said mandrel spline means and liner rigid splines may be reengaged by manipulating the operating string for rotating the liner.

4. In an arrangement for supporting on an operating string to manipulate and position a liner on a casing in a well bore, the invention comprising:

a mandrel for connection with the operating string;

release means for releasably connecting said mandrel with the liner;

liner rigid splines on the liner;

mandrel rigid splines on said mandrel;

release means for releasably securing said mandrel rigid splines on said mandrel and engaged with said liner rigid splines for rotating and reciprocating the liner in the well bore, said release means actuatable upon relative longitudinal movement between said mandrel and mandrel splines to disconnect said mandrel from said mandrel splines; and cooperating means on said mandrel and mandrel rigid splines for reconnecting said mandrel and mandrel rigid splines together whereby said mandrel rigid splines may be disengaged from said liner rigid splines upon longitudinal movement of said mandrel.

5. An arrangement for supporting on an operating string to manipulate and position a rotatable liner on a casing in a well bore, said arrangement comprising:

a mandrel for connection with the operating string;

first release means for releasably connecting said mandrel with the liner;

liner rigid spline means on the liner;

mandrel rigid spline means on said mandrel;

release means for releasably securing said mandrel rigid spline means on said mandrel and engaged with said liner rigid spline means for rotating and reciprocating the liner in the well bore, said release means actuatable upon relative movement between said mandrel and mandrel rigid spline means to disconnect said mandrel from said mandrel rigid spline means; and cooperating means on said mandrel and mandrel rigid spline means for reconnecting said mandrel and mandrel rigid spline means together whereby said mandrel rigid spline means may be disengaged from said liner rigid spline means upon longitudinal movement of said mandrel so that said first release means is actuatable upon manipulation of the operating string to disconnect said mandrel from the liner after the rotatable liner is supported on the casing whereupon said mandrel rigid spline means and liner spline means may thereafter be reengaged by manipulating the operating string to rotate the rotatable liner after it is supported on the casing in the well bore.

6. An arrangement for supporting on an operating string to manipulate and position a liner on a casing in a well bore, said arrangement comprising:

a mandrel for connection with the operating string; threads on said mandrel and liner for releasably securing them together; liner rigid spline means on the liner; mandrel rigid spline means on said mandrel; shear means for initially connecting said mandrel spline means to said mandrel and in engagement with said liner rigid spline means whereby the operating string may selectively rotate and reciprocate the liner before it is positioned on the liner, said shear means responsive to relative longitudinal movement between said mandrel and mandrel rigid spline means to release said mandrel rigid spline means from said mandrel after the liner has been positioned in the casing; and annular recesses on said mandrel and mandrel rigid spline means and a contractible member carried by said mandrel rigid spline means cooengageable upon relative longitudinal movement between said mandrel rigid spline means and mandrel to reconnect said mandrel and mandrel rigid splines whereupon said mandrel and liner rigid splines may be reengaged by manipulating the operating string for rotating the liner.

7. The arrangement of claims 1, or 2, or 3, or 4, or 5, or 6 including seal means for sealing between the operating string and the liner; and hanger means for securing the liner to the casing in the well bore.

8. The apparatus of claims 1, or 2, or 3, or 4, or 5, or 6 including: seal means for sealing between the operating string and the liner; said seal means including:

body means for fitting between the operating string and the liner;

seal means on said body for engaging the liner and operating string for sealing therebetween;

cooperating surface means on the liner operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess;

means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other; and means for positioning the liner to the casing in the well bore;

said means for positioning the liner to the casing in the well bore including:

hanger means on the liner for securing the liner to the casing in the well bore, said hanger means including at least one cone shaped enlargement; at least one slidable sleeve means; slip means on said slidable sleeve means; and bearing means for accommodating rotation of the liner;

cooperating latch means on said slidable sleeve means for releasably securing said slidable sleeve means and latch means together;

said latch means including:

a J-shaped slot in said slidable sleeve means;

lug means on the liner and engaged in said slot; and bow spring means on said slidable sleeve means engagable with the well bore casing whereby as the liner and sleeve means move through the well bore casing in one direction said lug means is positioned in said slot to restrain relative longitudinal and rotation movement between the liner and said slidable sleeve means; and said latch means, upon longitudinal movement of the liner in the other direction in the well bore casing and then rotating it while said slidable sleeve means is restrained by said bow spring means engaging the well bore casing, releasing to accommodate longitudinal movement of said slip means relative to the liner to engage said slip means and cone shaped enlargement for urging said slip means radially into gripping engagement with the well bore casing.

9. The apparatus of claims 1, or 2, or 3, or 4, or 5, or 6 including:

seal means for sealing between the operating string and the liner;

said seal means including:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

means for positioning the liner to the casing in the well bore; said means for positioning the liner to the casing in the well bore including hanger means on the liner for securing the liner to the casing in the well bore, said hanger means including at least one cone shaped enlargement; at least one slidable sleeve means; slip means on said slidable sleeve means; the liner having at least one annular chamber thereon in which one end of one of said slidable sleeve means is telescopically received;

bearing means for accommodating rotation of the liner; and seal means sealing between the annular chamber and said slidable sleeve means responsive to fluid pressure through a port in the liner for moving said slidable sleeve means longitudinally for engagement of said slip means with said cone shaped enlargement for urging said slip means radially into gripping engagement with the well bore casing.

10. The apparatus of claims 1, or 2, or 3, or 4, or 5, or 6 wherein said seal means includes:

seal means for sealing between the operating string and the liner;

said seal means including:

body means for fitting between the operating string and the liner;

seal means on said body for engaging the liner and operating string for sealing therebetween;

cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

means for positioning the liner to the casing in the well bore;

said means for securing the liner to the casing in the well bore including hanger means for hanging the liner on the well bore casing, said hanger means including first sleeve means mounted on the liner for rotation of the liner relative thereto at least two longitudinally spaced annular rows of conically shaped, circumferentially spaced segments on said first sleeve means with the segments in each row being off-set circumferentially; second sleeve means slidably mounted on the liner for relative rotation and longitudinal movement between said second sleeve means and the liner, said second sleeve means being spaced from said first sleeve means; at least two rows of hanger slips supported by said second sleeve means with said hanger slips in each row being off-set circumferentially and with said hanger slips in each row being aligned with the segments in a row of segments; means secured to said hanger slips adjacent one end and to said second sleeve means at the other end; and bearing means for accommodating rotation of the liner;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

a J-shaped slot in said second sleeve means; lug means on the liner and engaged in said slot; bow spring means on said second sleeve means engageable with the well bore casing whereby as the liner and said first and second sleeve means move through the well bore casing in one direction said lug means is positioned in said slot to restraing relative longitudinal movement between the liner and said second sleeve means; and said latch means, upon longitudinal movement of the liner in the other direction in the well bore casing and then rotating it while said second sleeve means is restrained by said bow spring means engaging the well bore casing, releasing to accommodate longitudinal movement of said second sleeve means relative to the liner to engage said hanger slips and conical segments for urging said hanger slips radially into gripping engagement with the well bore casing.

11. The apparatus of claims 1, or 2, or 3, or 4, or 5, or 6 including:

seal means for sealing between the operating string and the liner;

said seal means including:

body means for fitting between the operating string and the liner; seal means on said body for engaging the liner and operating string for sealing therebetween; cooperating surface means on the liner, operating string and said body means engageable with each other to lock said body means to the liner for sealing between the liner and operating string while accommodating axial movement of the operating string, said cooperating surface means including a recess in the liner, projection means on said body means engageable in the liner recess; and surface means carried on the operating string to urge said projection means into the recess in the liner to maintain said projection means engaged in the liner recess; and means to unlock said cooperating surface means on the liner and said body means from each other upon a predetermined amount of further relative longitudinal movement between the operating string and said body means whereby said body means may be retrieved with the operating string from the well bore, said means to unlock including additional surface means on the operating string which is positionable when the operating string is moved longitudinally a predetermined amount relative to said body means to release said cooperating surface means on the liner, operating string and said body means from each other;

means for positioning the liner in the well bore;

said seal means for securing the liner to the casing in the well bore including hanger means for hanging the liner on the well bore casing, said hanger means including first sleeve means mounted on the liner for rotation of the liner relative thereto; at least two longitudinally spaced annular rows of conically shaped, circumferentially spaced segments on said first sleeve means with the segments in each row being off-set circumferentially; second sleeve means slidably mounted on the liner for relative rotation and longitudinal movement between said second sleeve means and the liner, said second sleeve means being spaced from said first sleeve means; at least two rows of hanger slips supported by said second sleeve means with said hanger slips in each row being off-set circumferentially and with said hanger slips in each row being aligned with the segments in a row of segments; means secured to said hanger slips adjacent one end and to said second sleeve means at the other end; and bearing means for accommodating rotation of the liner;

release means for releasably securing said second sleeve means to the liner whereby said second sleeve means may be released for relative longitudinal movement between it and said first sleeve means to simultaneously engage all said rows of hanger slips on said respective rows of conical segments to hang the liner in the well bore casing by said hanger means;

said release means including:

an annular longitudinally extending chamber in the liner in which one end of said second sleeve means is telescopically received; and seal means sealing between the annular chamber and said second sleeve means responsive to fluid pressure through a port in the liner for moving said second sleeve means longitudinally for engagement of said hanger slips with said conical segments for urging said hanger slips radially into gripping engagement with the well bore casing.

12. A method of selectively rotating and/or reciprocating a liner that is rotatably supported and releasably secured on an operating string for lowering into a well bore having a casing and wherein the liner has rigid spline means thereon engageable with rigid spline means which is releasably connected to the operating string comprising the steps of:

lowering the operating string and liner connected therewith into the well bore with the liner rigid spline means and operating string rigid spline means engaged;

selectively rotating and/or reciprocating the liner in the well bore;

positioning the liner on the casing;

disconnecting the operating string from the operating string rigid spline means;

disconnecting the operating string rigid spline means from the liner rigid spline means;

disconnecting the operating string from the liner;

reconnecting the operating string with the operating string rigid means;

manipulating the operating string to reconnect the operating string rigid spline means with the liner rigid spline means; and manipulating the well string to rotate the positioned liner in the well bore.

13. A method of selectively rotating and/or reciprocating a liner that is rotatably supported and releasably secured on an operating string for lowering into a well bore having a casing and wherein the liner has rigid spline means thereon engageable with rigid spline means which is releasably connected to the operating string comprising the steps of:

lowering the operating string and liner supported thereon into the well bore;

positioning the liner on the casing;

lowering the operating string to disconnect the operating string from the operating string rigid spline means while retaining the operating string and liner rigid spline means engaged;

elevating the operating string to disconnect the operating string rigid spline means from the liner rigid spline means;

rotating the operating string to disconnect the operating string from the liner;

lowering the operating string to reconnect the operating string and liner rigid spline means;

manipulating the operating string to reconnect the operating string rigid spline means and the liner rigid spline means; and rotating the well string to rotate the liner in the well bore.

* * * * *